United States Patent [19]

Oda et al.

[11] 4,255,247

[45] Mar. 10, 1981

[54] ELECTRODE

[75] Inventors: Yoshio Oda; Hiroshi Otouma; Eiji Endoh, all of Yokohama, Japan

[73] Assignee: Asahi Glass Company, Limited, Tokyo, Japan

[21] Appl. No.: 879,751

[22] Filed: Feb. 21, 1978

[30] Foreign Application Priority Data

Feb. 18, 1977 [JP] Japan ..... 52-16122

[51] Int. Cl.[3] ..... C25B 11/06; C25B 1/46

[52] U.S. Cl. ..... 204/293; 204/290 R; 204/290 F; 252/477 Q; 429/44

[58] Field of Search ..... 429/44; 252/477 Q; 204/290 R, 292, 293

[56] References Cited

U.S. PATENT DOCUMENTS

| | | | |
|---|---|---|---|
| 3,248,787 | 5/1966 | Plust et al. | 429/45 X |
| 3,380,934 | 4/1968 | Batzold | 252/477 Q |
| 3,637,437 | 1/1972 | Goldberger | 429/44 |
| 3,673,116 | 6/1972 | Richter | 252/466 T |
| 3,997,478 | 12/1976 | Petro | 252/47 D |
| 4,024,044 | 5/1977 | Brannan et al. | 204/242 |

FOREIGN PATENT DOCUMENTS

| | | | |
|---|---|---|---|
| 51-54877 | 5/1976 | Japan . | |
| 634097 | 3/1950 | United Kingdom | 252/477 Q |
| 1132833 | 11/1968 | United Kingdom | 204/292 |

*Primary Examiner*—F. C. Edmundson

*Attorney, Agent, or Firm*—Oblon, Fisher, Spivak, McClelland & Maier

[57] ABSTRACT

An electrode is prepared by etching an alloy substrate comprising a first metallic component selected from the group consisting of chromium, manganese, tantalum, niobium, vanadium, titanium, silicon, zirconium, germanium, scandium, yttrium and lanthanum and a second metallic component selected from the group consisting of iron, nickel, tungsten, copper, silver, cobalt and molybdenum to remove at least part of the first metallic component.

31 Claims, 3 Drawing Figures

(Fe + Ni + Cr = 100)

(Fe + Ni + Cr = 100)

ELECTRODE

BACKGROUND OF THE INVENTION

1. Field of the Invention

The present invention relates to an electrode. More particularly, it relates to an electrode especially a cathode which is used in an electrolysis of an aqueous solution at a reduced cell voltage.

2. Description of the Prior Arts

Various anticorrosive electrodes have been used in electrolysis of aqueous solutions to obtain electrolyzed products such as electrolysis of an aqueous solution of an alkali metal chloride to obtain an alkali metal hydroxide and chlorine.

When an overvoltage of the electrode caused in an electrolysis of an aqueous solution such as an aqueous solution of alkali metal chloride is lowered, the electric power consumption can be reduced and the electrolyzed product can be obtained at lower cost.

In order to reduce a chlorine overvoltage of an anode, various studies have been made on the materials on the substrate and the treatments. Some of them have been practically employed.

It has been needed to use an electrode having a low hydrogen overvoltage and an anticorrosive characteristic since the diaphragm method for an electrolysis using a diaphragm has been developed.

In the conventional electrolysis of an aqueous solution of an alkali metal chloride using an asbestos diaphragm, iron plate has been used as a cathode.

It has been proposed to treat a surface of an iron substrate by a sand blast treatment in order to reduce a hydrogen overvoltage of the iron substrate (for example, Surface Treatment Handbook Pages 541 to 542 (Sangyotosho) by Sakae Tajima). However, the asbestos diaphragm method has disadvantages of a low concentration of sodium hydroxide as about 10 to 13 wt. % and a contamination of sodium chloride in an aqueous solution of sodium hydroxide. Accordingly, the electrolysis of an aqueous solution of an alkali metal chloride using an ion exchange membrane as a diaphragm has been studied developed and practically used. In accordance with the latter method, an aqueous solution of sodium hydroxide having high concentration of 25 to 40 wt. % may be obtained. When the iron substrate is used as a cathode in the electrolysis the iron substrate is broken by stress cracking in corrosion or a part of the iron substrate is dissolved in a catholyte because of high concentration of sodium hydroxide high temperature such as 80° to 120° C. in an electrolysis.

It has been preferable to use an alkali resistant anticorrosive substrate such as iron-nickel alloy, iron-nickel-chromium alloy-nickel, nickel alloy and chromium alloy as the substrate of the cathode. However, in the electrolysis of an aqueous solution of an alkali metal chloride using these cathodes, the hydrogen overvoltage is high and the electric power consumption is large and the cost for producing the electrolyzed products is high in comparison with those of the iron cathode. In the specification, the substrate means the material of the electrode and the etching treatment means the etching.

SUMMARY OF THE INVENTION

It is an object of the present invention to provide an electrode having high alkali resistance and low overvoltage.

It is another object of the present invention to provide a cathode being suitable for an electrolysis of an aqueous solution of an alkali metal chloride by an ion-exchange membrane method.

It is the other object of the present invention to provide an electrode maintaining a low hydrogen overvoltage for a long time.

It is an object of the present invention to obtain an electrode especially a cathode by which the hydrogen overvoltage is effectively lowered and the lowering effect is maintained for a long time in an electrolysis using said anticorrosive substrate as the electrode.

The foregoing and other objects of the present invention have been attained by removing a part of the metallic component of the alloy substrate from the surface of the substrate.

The electrode of the present invention is prepared by removing at least part of a first metallic component from a surface of an alloy substrate comprising a first metallic component selected from the group consisting of chromium, manganese, tantalum, niobium, vanadium, titanium, silicon, zirconium, germanium, scandium, yttrium and lanthanum and a second metallic component selected from the group consisting of iron, nickel, tungsten, copper, silver, cobalt and molybdenum.

DETAILED DESCRIPTION OF THE PREFERRED EMBODIMENTS

Figure 1:
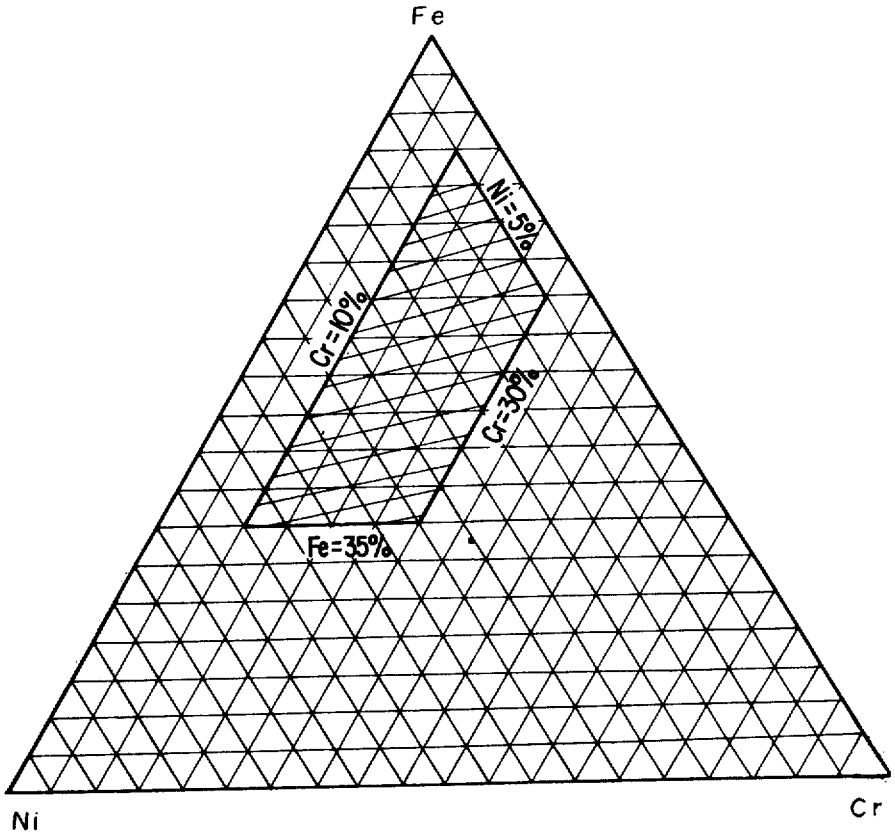
FIG. 1 is a triangular coordinate showing suitable metal compositions on the surface of the electrode substrate; used in the present invention.

The surface of the electrode of the present invention has excellent alkali resistance and has fine porous structure whereby the effect of low hydrogen overvoltage can be maintained for a long time.

The first metallic components used in the present invention are easily dissolved into an aqueous solution of an alkali metal hydroxide under a specific condition in comparison with the second metallic components. However, the first metallic components are not substantially dissolved under the normal condition of electrolysis.

The first metallic component is at least one metal selected from the group consisting of Cr, Mn, Ta, Nb, V, Ti, Si, Zr, Ge, Sc, Y and lanthanum group metals. It is especially preferable to select Cr, Mn or Ti.

On the other hand, the second metallic components used in the present invention have low hydrogen overvoltage and should not be dissolved into an aqueous solution of an alkali metal hydroxide under the condition of dissolving the first metallic component.

The second metallic component is at least one metal selected from the group consisting of Fe, Ni, W, Cu, Ag, Co and Mo. It is especially preferable to use Fe, Ni, Mo or Co.

In the present invention, the desirable effect can be attained by using an alloy made of the first metallic component of metal or alloy and the second metallic component of metal or alloy.

Accordingly, the first and second metallic components defined above have been selected. The optimum alloys include iron-nickel-chromium alloy, iron-chromium alloy, nickel-molybdenum-chromium alloy, nickel-molybdenum-manganese alloy and nickel-chromium alloy.

The metallic substrates having surfaces made of the alloy, include commercially available stainless steels, nickel-alloys such as nichrome, Inconel, Illium (Burgess Parr Co. in U.S.A. and Hastelloy-426 & Haynes Setellite Co. in U.S.A.) which are easily available and the electrodes having low hydrogen overvoltage and long durability can be prepared and it is preferable to use them in an industrial purpose.

In the present invention, a ratio of the first metallic component to the second metallic component as the electrode substrate before the treatment for removing at least part of the first metallic component is dependent upon the kinds of the first and second metallic components and it is usually preferable to be 1 to 30 wt. % of the first metallic component and 99 to 70 wt. % of the second metallic component.

When the ratio is out of the range, a lowering of overvoltage may not be satisfactory or the durability of the overvoltage lowering effect can not be expected, disadvantageously.

The optimum ratio is 15 to 25 wt. % of the first metallic component and 85 to 75 wt. % of the second metallic component.

The first and second metallic components can be respectively alloys. The above defined ratio is considered to be a ratio of the first metallic component or the second metallic component to the total metallic components.

It is possible to contain the other components beside the first and second metallic components in the alloy substrate when the characteristic of the alloy is not substantially deteriorated.

The third metallic components beside the first and second metallic components can be platinum group metal, oxides thereof and alloys thereof. The total amount of the first and second metallic components in the alloy of the electrode substrate is more than 70 wt. %.

The kinds and formula of the optimum alloys used as the electrode substrate are austenite type stainless steel having the formula shown in FIG. 1 wherein Fe+-Ni+Cr=100. That is, the optimum alloys comprise 10 to 30 wt. % of Cr; 5 to 55 wt. % of Ni and 35 to 85 wt. % of Fe. The alloys comprising 10 to 30 wt. % of Cr; 5 to 45 wt. % of Ni and 45 to 75 wt. % of Fe are also preferably used. The alloys comprising 15 to 25 wt. % of Cr; 5 to 40 wt. % of Ni and 45 to 75 wt. % of Fe are also preferably used.

The stainless steel can be martensite type stainless steel, ferrite type stainless steel and austenite type stainless steel. It is optimum to use the austenite type stainless steel from the viewpoints of lower hydrogen overvoltage and longer durability. In detail, it is preferable to use the stainless steels SUS 304, SUS 304L, SUS 316, SUS 309, SUS 316L and SUS 310S defined in Japanese Industrial Standard. It is also preferable to use NAS 144MLK, NAS 174X, NAS-175, NAS 305, NAS 405E etc. (manufactured by Nippon Yakin K.K.). The alloys having the formula are suitable as the substrate for the electrodes which result in low hydrogen overvoltage and are commercially available at low cost.

In the present invention, the electrode is prepared by using a substrate having the alloy surface. The electrode substrate can be made of only said alloy or can be also have an alloy layer on the surface of the substrate. The alloy layer should be in a depth of 0.01 to 50μ from the surface of the substrate.

The electrode substrates having the alloy layer can be prepared by using the commercially available stainless steels or nickel alloys.

In the present invention, the preparation of the alloys is not critical. For example, the metallic components selected from the first and second metallic components are thoroughly mixed in the form of fine powder, and the mixture can be alloyed by the conventional methods such as the melt-quenching method, an alloy electric plating method, an alloy nonelectric plating method, an alloy sputtering method, etc.

The metallic substrate having the alloy at the surfaces of the present invention can be prepared.

The shape of the metallic substrate is substantially the same as the shape of the electrode.

In the present invention, at least part of the first metallic component is selectively removed from the surface of the electrode substrate.

In the present invention, the degree of removing the first metallic component from the surface of the alloy substrate as the electrode, is suitable to form many fine pores having depths of about 0.01 to 50μ at a rate of about $10^3$ to $10^8$ per 1 $cm^2$. (number of pores per 1 $cm^2$)

When the depth is less than the range, the satisfactory overvoltage lowering effect can not be expected and the durability is relatively short. When the depth is more than the range, further effect can not be expected and the treatment is complicated and difficult disadvantageously.

When the numbers of the pores are more than the range, the satisfactory overvoltage lowering effect can not be expected and the durability is relatively short and the mechanical strength may be partially lowered not to be enough.

When the first metallic component is removed from the surface of the alloy substrate as the electrode to form many fine pores having depths of about 0.01 to 20μ at a rate of about $10^6$ to $10^7$ per 1 $cm^2$, the hydrogen overvoltage is especially lowered and the durability is highered, advantageously.

The condition of the surface of the electrode (porosity) can be measured by the electric double layer capacity. From the viewpoint of the durability of low hydrogen overvoltage, it is preferable to be greater than 5000 $\mu F/cm^2$, preferably greater than 7500 $\mu F/cm^2$ and especially greater than 10000 $\mu F/cm^2$. The electric double layer capacity is the ionic double layer capacity. When the surface area is increased by increasing the porosity, the ionic double layer capacity of the surface of the electrode is increased. Accordingly, the porosity of the surface of the electrode can be considered from the data of the electric double layer capacity.

The ratio for removing the first metallic component from the surface of the alloy substrate as the electrode, is preferably about 10 to 100%, especially 30 to 70% of the first metallic component in the part of the depth of 0.01 to 50μ from the surface.

When the ratio for removing the first metallic component is less than the range, the hydrogen overvoltage lowering effect is not enough high.

Figure 2:
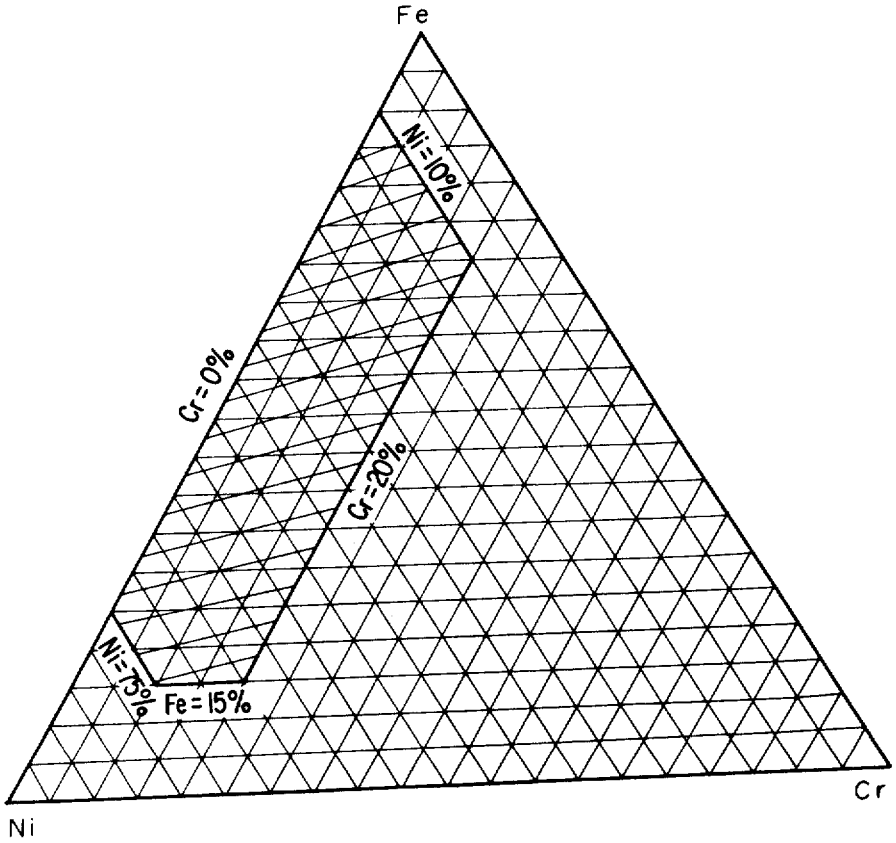
FIG. 2 is a triangular coordinate showing suitable metal composition of the surface layer of the electrode treated.

When the austinite stainless steel shown in FIG. 1 is used as the substrate, the formula of the alloy of the surface layer of the electrode left by removing at least part of the first metallic component is preferably the formula shown in FIG. 2 wherein the surface layer comprises 15 to 90 wt. % of Fe; 10 to 75 wt. % of Ni and 0 to 20 wt. % of Cr preferably 20 to 75 wt. % of Fe, 20 to 70 wt. % of Ni and 5 to 20 wt. % of Cr especially 30 to 65 wt. % of Fe, 30 to 65 wt. % of Ni and 5 to 20 wt. % of Cr.

FIG. 2 shows the average components in the surface layer of the electrode in the depth of 0 to 50μ.

In the method of removing the first metallic component in the present invention, the first metallic component can be selectively removed by the following etching.

When the electrode treated by the etching is used as a cathode in an electrolysis of an aqueous solution of alkali metal chloride, the left first metallic component is not substantially dissolved during the electrolysis. Accordingly, when the electrode of the present invention is used, the quality of sodium hydroxide obtained from the cathode compartment of the electrolytic cell is not deteriorated.

Moreover, the electrode of the present invention has low hydrogen overvoltage and has a long durability.

In order to remove at least part of the first metallic component from the surface of the metallic substrate, the following treatments can be employed: chemical etching by immersing the alloy substrate into a solution which selectively dissolves the first metallic component such as alkali metal hydroxides e.g. sodium hydroxide and barium hydroxide, etc; electro-chemical etching treatment by selectively dissolving the first metallic component from the surface of the alloy substrate by the anodic polarization in an aqueous medium having a high electric conductivity such as alkali metal hydroxides, sulfuric acid, hydrochloric acid, chlorides, sulfates and nitrates.

When the former chemical etching is employed, it is preferable to carry it out at about 90° to 250° C. for about 1 to 500 hours, preferably 15 to 200 hours. It can be carried out under high pressure or in an inert gas atmosphere.

The solution of alkali metal hydroxide or such as sodium hydroxide, potassium hydroxide is especially effective as the etching solution. The concentration is usually in a range of 5 to 80 wt. %, preferably 30 to 75 wt. %, especially 40 to 70 wt. % as NaOH at 90° to 250° C., preferably 120° to 200° C., especially 130° to 180° C.

When the etching is carried out in the solution of an alkali metal hydroxide, and the electrode is used as the cathode in the electrolysis of an aqueous solution of an alkali metal chloride, it is preferable to give conditions of the concentration and the temperature which are more severe than those of the alkali metal hydroxide in a cathode compartment. Thus, the left first metallic component is not further dissolved during the use of the electrode.

When the latter electro-chemical etching is employed, the following two methods can be employed.

As the one method, it is suitable to give an anodic polarization of the alloy substrate to a saturated calomel electrode in an electrolytic cell at a potential of −3.5 to +2.0 volt. for 1 to 500 hours.

As the other method, it is suitable to give a potential for an anodic polarization to the alloy substrate in an electrolytic cell and to treat it in the current density of 100 μA to 10,000 A/dm$^2$ for 1 to 500 hours.

In the present invention, the sand blast treatment or the wire brushing can be employed together with the etching.

When the pretreatment for forming a rough surface such as the sand blasting or the brushing is applied before the etching, the etching can be effectively attained for a short time. In order to attain the pretreatment, it is preferable to form pores having depths of 0.01 to 50 at a rate of $10^3$ to $10^6$ per 1 cm$^2$ on the surfaces of the alloy substrate.

The shape of the electrode of the present invention is not limited. For example, suitable shapes such as plates having many pores for gas discharge or no pore, and strips, nets and expanded metals.

All of the electrode can be made of the alloy or the electrode can have a core made of titanium, copper, iron, nickel or stainless steel, and a coated layer (electrode functional surface) made of the alloy used for the present invention.

The present invention will be further illustrated by certain examples.

EXAMPLE 1

Both surfaces of a stainless steel plate SUS-304(Fe: 71%; Cr: 18%; Ni: 9%; Mn: 1%; Si: 1% and C: 0.06%) having smooth surfaces and a size of 50 mm×50 mm×1 mm, were uniformly sand-blasted with α-alumina sand (150 to 100μ) in a sand blaster for about 2 minutes on each surface.

The surface was observed by a scanning type electron microscope (manufactured by Nippon Denshi K.K.) to find that depths of pores were 0.08 to 8μ and numbers of pores were about $4\times10^5$ per 10 cm$^2$.

In a 1000 cc autoclave made of SUS-304, a 500 cc beaker made of a fluorinated resin (The fluorinated resin for the beaker is polytetrafluoroethylene in the examples.) was inserted and 400 cc of 40% aqueous solution of NaOH was charged and the sand blasted plate was dipped and the etching of the plate was carried out at 150° C. for 65 hours under the pressure of about 1.3 Kg/cm$^2$ G.

The plate was taken out and the surface of the plate was observed by the scanning type electron microscope. Depth of pores on the surface was 0.1 to 10μ and numbers of pores were about $4\times10^6$/cm$^2$.

The average contents of the components of the alloy in the surface layer in the depth of 0 to 50μ were 58% of Fe; 31% of Ni, 10% of Cr; 0.5% of Mn; 0.5% of Si and 0.02% of C.

The electric double layer capacity was measured by the following method and it was 12000 μF/cm$^2$.

The test piece was immersed into 40% aqueous solution of NaOH at 25' C. and a platinized platinum electrode having 100 times of an apparent surface of the test piece was inserted to form a pair of the electrodes and the cell impedance was measured by Kohlraush's bridge and the electric double layer capacity of the test piece was calculated.

An electrolysis of an aqueous solution of sodium chloride was carried out by using the treated plate as a cathode and a titanium net coated with ruthenium oxide as an anode.

A pefluorosulfonic acid membrane (Naphion-120 manufactured by DuPont) was used as a diaphragm. A saturated aqueous solution of NaCl having pH of 3.3 was used as an anolyte and an aqueous solution of NaOH (570 g/liter) was used as a catholyte. The temperature in an electrolytic cell was kept at 90° C. and the current density was kept at 20 A/dm$^2$. The cathode potential vs a saturated calomel electrode was measured by using a Luggil capillary. Hydrogen overvoltage was calculated to be 0.06 Volt.

When the untreated stainless steel plate (SUS-304) was used as the cathode instead of the treated one, a hydrogen overvoltage was 0.20 Volt.

EXAMPLE 2 to 15

In accordance with the process of Example 1, the following plates were etched with sodium hydroxide and hydrogen overvoltages were measured. The results are as follows.

The components of each plate were as follows.

SUS-304L: Fe: 71%; Cr: 18%; Ni: 9%; Mn: 1%; Si: 1%; C: 0.02%.

SUS-316: Fe: 68%; Cr: 17%; Ni: 11%; Mo: 2.5%; Mn: 1%; Si: 0.5%; C: 0.08%.

SUS-316L: Fe: 68%; Cr: 17%; Ni: 11%; Mo: 2.5%.

SUS-310S: Fe: 54%; Cr: 25%; Ni: 20%; Si: 1%.

Hastelloy C: Fe: 6%; Cr: 14%; Ni: 58%; Mo: 14%; W: 5%; Co: 2.5%; V: 0.5%.

Hastelloy A: Fe: 20%; Cr: 0.5%; Ni: 57%; Mn: 2; Mo: 20%; Si: 0.5%.

TABLE 1

| Example | 2 | 3 | 4 | 5 | 6 | 7 | 8 | 9 | 10 | 11 | 12 | 13 | 14 | 15 |
|---|---|---|---|---|---|---|---|---|---|---|---|---|---|---|
| Material of cathode | SUS-304 | SUS-304 | SUS-304 | SUS-304 | SUS-304 | SUS-304 | SUS-304 | SUS-304 | SUS-304L | SUS-316 | SUS-316L | SUS-310S | Hastelloy C | Hastelloy A |
| Numbers of concaves | $4 \times 10^6$ | $4 \times 10^6$ | $4 \times 10^6$ | $4 \times 10^6$ | $4 \times 10^6$ | $4 \times 10^6$ | $4 \times 10^6$ | $4 \times 10^6$ | $5 \times 10^6$ | $3 \times 10^6$ | $4 \times 10^6$ | $3 \times 10^6$ | $2.5 \times 10^6$ | $2.5 \times 10^6$ |
| NaOH etching condition | | | | | | | | | | | | | | |
| Temperature(°C.) | 150 | 150 | 120 | 120 | 100 | 100 | 150 | 150 | 150 | 150 | 150 | 150 | An 150 | |
| Time (hr) | 30 | 250 | 65 | 250 | 300 | 600 | 65 | 65 | 65 | 65 | 65 | 65 | 65 | 65 |
| Hydrogen overvoltage (V) | | | | | | | | | | | | | | |
| Untreated | 0.36 | 0.36 | 0.36 | 0.36 | 0.36 | 0.36 | 0.36 | 0.36 | 0.35 | 0.37 | 0.38 | 0.40 | 0.42 | 0.41 |
| After sand blast treatment | 0.20 | 0.20 | 0.20 | 0.20 | 0.20 | 0.20 | 0.20 | 0.20 | 0.19 | 0.22 | 0.23 | 0.23 | 0.18 | 0.19 |
| After etching treatment | 0.06 | 0.05 | 0.08 | 0.07 | 0.10 | 0.10 | 0.10 | 0.07 | 0.07 | 0.06 | 0.08 | 0.09 | 0.12 | 0.11 |
| Note | | | | | | | *1 | *2 | | | | | | |

Note:
*1: An expand metal: diameters of wires of 1.0 mm.
*2: Air in the autoclave was purged with nitrogen.

The electric double layer capacities of the electrodes were as follows.

| Example | Electric double layer capacity ($\mu F/cm^2$) |
|---|---|
| 2 | 14,000 |
| 3 | 18,000 |
| 4 | 9,500 |
| 5 | 1,000 |
| 6 | 8,500 |
| 7 | 8,500 |
| 8 | 15,000 |
| 9 | 13,000 |
| 10 | 14,000 |
| 11 | 10,000 |
| 13 | 7,500 |
| 14 | 8,000 |
| 15 | 8,500 |

EXAMPLES 16 to 21

In accordance with the process of Example 1, the following plates were etched with sodium hydroxide and hydrogen overvoltages and electric double layer capacities were measured. The results are as follows.

The components of each plate were as follows.

SUS 309S; Fe: 64%; Cr: 22%; Ni: 13%; Mn: 0.05%; Si: 0.8%; C: less than 0.03%.

NAS 144MLK; Fe: 68%; Cr: 16%; Ni: 15%; Mn: 1.7%; Si: 0.8%; C: 0.01%.

NAS 175X; Fe: 69%; Cr: 17%; Ni: 22%; Mn: 1.4%; Si: 0.7%; Cr: 0.02%.

TABLE 2

| Example | 16 | 17 | 18 | 19 | 20 | 21 |
|---|---|---|---|---|---|---|
| Material of cathode | SUS-309S | NAS-144 MLK | NAS-174X | SUS-316L | SUS-310S | SUS-309S |
| Number of concaves | $3 \times 10^6$ | $3 \times 10^6$ | $2.5 \times 10^6$ | $4 \times 10^6$ | $4 \times 10^6$ | $4 \times 10^6$ |
| NaOH etching condition | | | | | | |
| Concentration of NaOH (%) | 40% | 40% | 40% | 70% | 70% | 70% |
| Temperature (° C.) | 160 | 160 | 160 | 165 | 165 | 165 |
| Time (hr) | 65 | 65 | 65 | 50 | 50 | 50 |
| Hydrogen overvoltage (V) | | | | | | |
| Untreated | 0.40 | 0.38 | 0.36 | 0.38 | 0.40 | 0.40 |
| After sand blast treatment | 0.24 | 0.23 | 0.22 | 0.23 | 0.23 | 0.24 |
| After etching | 0.10 | 0.12 | 0.10 | 0.06 | 0.07 | 0.07 |

TABLE 2-continued

| Example | 16 | 17 | 18 | 19 | 20 | 21 |
|---|---|---|---|---|---|---|
| treatment | | | | | | |
| Electric double layer capacity ($\mu F/cm^2$) | 10,000 | 9,500 | 10,000 | 13,000 | 13,500 | 12,500 |

EXAMPLE 22

A durability test of the electrode of Example 8 was carried out under the same electrolysis of Example 1.

During about 3000 hours of the operating of the electrolysis, the hydrogen overvoltage was 0.10 Volt which was equal to the hydrogen overvoltage at the initiation.

EXAMPLE 23

Both surfaces of a stainless steel plate SUS-304 having smooth surfaces and a size of 50 mm×50 mm×1 mm were uniformly treated by a sand blast with α-alumina sand (150 to 100μ) in a sand blaster for about 2 minutes on each surface.

In a 500 cc beaker made of a fluorinated resin, 400 cc of 40% aqueous solution of NaOh was charged and a potentio static polarization was carried out. The sand blasted electrode was maintained at −0.3 V vs a saturated calomel electrode by the potentio state (manufactured by HOKUTO D. K.K.) for 3 hours at 120° C. in the beaker.

The surface of the resulting plate was observed by a scanning type electron microscope (manufactured by Nippon Denshi K.K.) to find that the depths of pores were 0.1 to 10μ and the numbers of pores were about $4\times10^6$ per 1 $cm^2$.

The average contents of the components of the alloy in the surface layer in the depth of 0 to 50μ were 57% of Fe; 35% of Ni; 7% of Cr; 0.5% of Mn; 0.5% of Si and 0.02% of C.

The electric double layer capacity was 10500 $\mu F/cm^2$.

An electrolysis of an aqueous solution of sodium chloride was carried out by using the treated plate as a cathode and a titanium net coated with ruthenium oxide as an anode.

A perfluorosulfonic acid membrane was used as a diaphragm. A saturated aqueous solution of NaCl having pH of 3.3 was used as an anolyte and an aqueous solution of NaOH (570 g/liter) was used as a catholyte. The temperature in an electrolytic cell was kept at 90° C. and the current density was kept in 20 $A/dm^2$.

The cathode potential vs a saturated calomel electrode was measured by using Luggil capillary. A hydrogen overvoltage was calculated to be 0.12 Volt.

When the untreated stainless steel plate (SUS-304) was used as the cathode instead of the treated one, a hydrogen overvoltage was 0.36 Volt.

When the stainless steel plate (SUS-304) treated by the sand blasting was used as the cathode, a hydrogen overvoltage was 0.20 Volt.

EXAMPLES 24 to 28

In accordance with the process of Example 23, the potentio static polarization was carried out under the following conditions and hydrogen overvoltages were measured. The results are as follows.

The components of the solder alloy 426 were as follows.

Ni: 42%; Cr: 6%; Fe: 50%.

TABLE 3

| Example | 24 | 25 | 26 | 27 | 28 |
|---|---|---|---|---|---|
| Material of cathode | SUS-304 | SUS-316 | SUS-310S | Hastelloy C | Solder alloy 426 |
| Condition of potentio static polarization | | | | | |
| Temperature (°C.) | 120 | 120 | 130 | 130 | 130 |
| Time (hr) | 10 | 10 | 10 | 10 | 10 |
| Hydrogen overvoltage (V) | | | | | |
| Untreated | 0.36 | 0.37 | 0.40 | 0.42 | 0.41 |
| After sand blast treatment | 0.20 | 0.21 | 0.20 | 0.18 | 0.18 |
| After etching treatment | 0.11 | 0.10 | 0.08 | 0.07 | 0.08 |

EXAMPLE 29

Both surfaces of Hastelloy C having smooth surfaces and a size of 50 mm×50 mm×1 mm were uniformly treated by a sand blasting with α-alumina sand (150 to 100μ) in a sand blaster for about 2 minutes on each surface.

In a 500 cc beaker, 20% aqueous solution of HCl was charged and a galvano static anodic polarization (10 $A/dm^2$) was carried out by using the sand-blasted plate as an anode and a platinum plate as a cathode at 25° C. for 5 hours.

The surface of the resulting plate was observed by a scanning type electron microscope (manufactured by Nippon Denshi K.K.) to find that the depths of pores were 0.1 to 10μ and the numbers of pores were about $3\times10^5$ per 1 $cm^2$.

The average contents of the components of the alloy in the surface layer in the depth of 0 to 50μ were 17% of Fe; 60% of Ni; 4% of Cr; 12% of Mo; 5% of W; 2% of Co and 0% of V.

The electric double layer capacity was 7500 $\mu F/cm^2$.

An electrolysis of an aqueous solution of NaCl was carried out by using the etched plate as a cathode and a titanium net coated with ruthenium oxide as an anode.

A perfluorosulfonic acid membrane was used as a diaphragm. A saturated aqueous solution of NaCl having pH of 3.3 was used as an anolyte and an aqueous solution of NaOH (570 g/liter) was used as a catholyte. The temperature in an electrolytic cell was kept at 90° C. and the current density was kept in 20 $A/dm^2$.

The cathode potential vs a saturated calomel electrode was measured by using a Luggil capillary. A hydrogen overvoltage was calculated. It was 0.10 Volt.

When the untreated Hastelloy C plate was used as the cathode instead of the etched one, a hydrogen overvoltage was 0.42 Volt.

When the Hastelloy C plate treated by the sand blasting was used as the cathode, a hydrogen overvoltage was 0.18 Volt.

EXAMPLES 30 to 33

In accordance with the process of Example 29, the galvano static anodic polarizations of various plates was carried out under the conditions shown in Table 3 and the hydrogen overvoltages were measured. The results are as follows.

The components of Inconel are as follows.

Ni: 80%; Cr: 14%; Fe: 6%.

The Hastelloy C 276 is similar to Hastelloy C except reducing a carbon content to be negligible.

TABLE 4

| Example | 30 | 31 | 32 | 33 |
|---|---|---|---|---|
| Material of cathode | SUS-310S | In-conel | Hastelloy 276 | Hastelloy C |
| Condition of anodic polarization | | | | |
| Current density(A/dm$^2$) | 5 | 10 | 10 | 20 |
| Time (hr) | 5 | 5 | 5 | 5 |
| Hydrogen overvoltage (V) | | | | |
| Untreated | 0.40 | 0.41 | 0.40 | 0.40 |
| After sand blast treatment | 0.21 | 0.22 | 0.18 | 0.18 |
| After etching treatment | 0.09 | 0.11 | 0.08 | 0.11 |

EXAMPLE 34

A durability test of the electrode of Example 26 was carried out under the same electrolysis of Example 22.

After about 3000 hours of the electrolysis, the hydrogen overvoltage was 0.07 to 0.09 Volt which was not substantially changed.

EXAMPLE 35

In a 500 cc beaker made of a fluorinated resin, a stainless steel plate (SUS-304) having smooth surface and a size of 50 mm×50 mm×1 mm was put into it and 400 cc of 40% aqueous solution of NaOH was charged and the beaker was put into a 1000 cc autoclave made of stainless steel SUS-304, and an etching was carried out at 200° C. for 300 hours under the pressure of about 1.5 Kg/cm$^2$ G.

The etched plate was taken out and was observed by a scanning type electron microscope manufactured by Nippon Denshi K.K. The depths of pores were 0.1 to 10$\mu$ and the numbers of pores were about $4\times10^6$ per 1 cm$^2$.

The average contents of the components of the alloy in the surface layer in the depth of 0 to 50$\mu$ were 57% of Fe; 37% of Ni; 5% of Cr; 0.1% of Mn; 0.02% of Si and 0.02% of C.

The electric double layer capacity was 16000 $\mu$F/cm$^2$.

An electrolysis of an aqueous solution of NaCl was carried out by using the etched plate as a cathode and a titanium net coated with ruthenium oxide as an anode.

A perfluorosulfonic acid membrane (Naphion 120 manufactured by DuPont) was used as a diaphragm.

A saturated aqueous solution of NaCl having pH of 3.3 was used as an anolyte and an aqueous solution of NaOH (570 g/liter) was used as a catholyte. The temperature in the electrolytic cell was kept at 90° C. and the current density was kept in 20 A/dm$^2$.

The cathode potential vs a saturated calomel electrode was measured by using a Luggil capillary. A hydrogen overvoltage was calculated. It was 0.07 Volt.

When the untreated plate was used as the cathode instead of the etched one, a hydrogen overvoltage was 0.36 Volt.

EXAMPLE 36

A durability test of the electrode of Example 35 was carried out under the same electrolysis condition of Example 22.

After about 3000 hours in the electrolysis, the hydrogen overvoltage was 0.07 which was equal to the overvoltage at the initiation.

EXAMPLE 37

In accordance with the process of Example 1, the stainless steel plate SUS-304 having smooth surfaces was treated by the etching with 40% of aqueous solution of NaOH at 100° C. for 100 hours. The electric double layer capacity was 4,500 $\mu$F/cm$^2$. The durability of hydrogen overvoltage was measured. The result is shown in FIG. 3 together with the results of the durability tests for the electrodes of Example 6 and Example 35.

Figure 3:
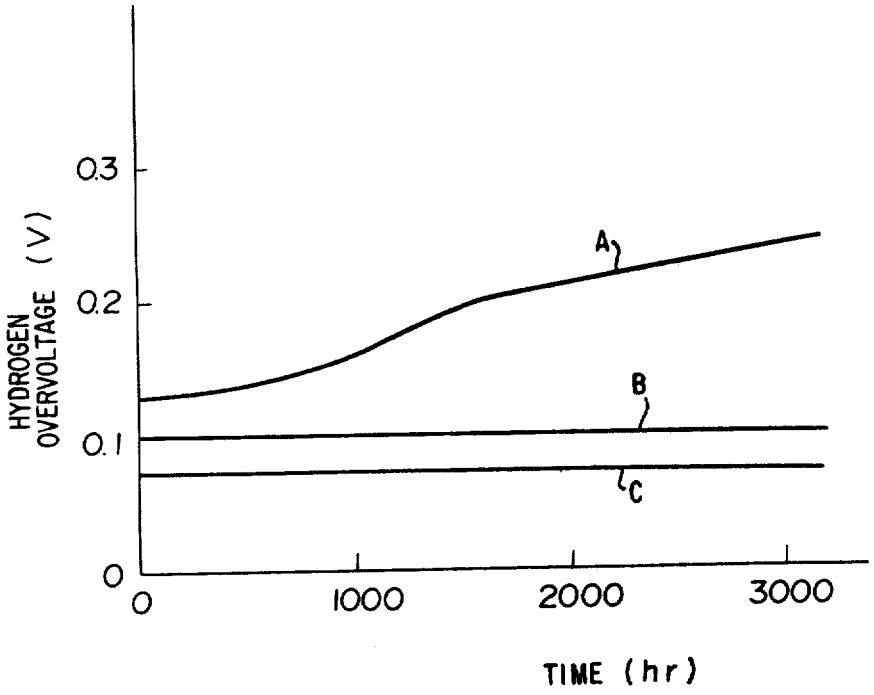
FIG. 3 is a graph showing relations of hydrogen overvoltage and times.

In FIG. 3, the reference Ⓐ designates the result in Example 37; Ⓑ designates the result in Example 6 and Ⓒ designates the result in Example 35.

What is claimed is:

1. An electrode prepared by etching at least a portion of a first metallic component from an alloy substrate which alloy comprises a first metallic component selected from the group consisting of chromium, manganese, tantalum, niobium, vanadium, titanium, silicon, zirconium, germanium, scandium, yttrium and lanthanum and a second metallic component selected from the group consisting of iron, nickel, tungsten, copper, silver, cobalt and molybdenum, wherein said alloy comprises 1 to 30 wt.% of the first metallic component and 99 to 70 wt.% of the second metallic component, and wherein said etching is sufficient to form $10^3$ to $10^8$ per cm$^2$ pores of average depths of 0.01 to 50$\mu$ on the surface of the substrate.

2. An electrode according to claim 1 wherein the electrode is a cathode used in an electrolysis of an aqueous solution of an alkali metal chloride.

3. An electrode according to claim 2 wherein the removement of the first metallic component is an etching treatment.

4. An electrode according to claim 3 wherein the etching is carried out immersing the alloy substrate in an aqueous solution of an alkali metal hydroxide at 90° to 250° C. for 1 to 500 hours.

5. An electrode according to claim 4 wherein the aqueous solution of an alkali metal hydroxide is an aqueous solution of sodium hydroxide.

6. An electrode according to claim 3 wherein the etching is an anodic polarization of the alloy substrate in an electrolytic cell under a potential of the plate to the saturated calomel electrode of −3.5 to +2.0 Volt for 1 to 500 hours.

7. An electrode according to claim 3 wherein the etching is to treat the alloy substrate in an electrolytic cell by applying a potential for an anodic polarization under a current density of 100 $\mu$A to 10,000 A/dm$^2$ for 1 to 500 hours.

8. An electrode according to claim 1 wherein the alloy is selected from the group consisting of iron-nickel-chromium alloy, iron-chromium alloy, nickel-molybdenum-chromium alloy, nickel-iron-molybdenum-manganese alloy and nickel-chromium alloy.

9. An electrode according to claim 1 wherein the alloy substrate is treated by a sand blasting before the etching.

10. An electrode according to claim 1 wherein the depth of the surface layer from which at least part of the first metallic component is removed is 0.01 to 50μ.

11. An electrode according to claim 1 wherein an electric double layer capacity of the surface layer is greater than 5000 $\mu F/cm^2$ 12. An electrode prepared by etching at least a portion of a first metallic component from an alloy substrate which alloy comprises chromium as the first metallic component and nickel as a second metallic component wherein the alloy comprises components of 10 to 30 wt.% Cr, 5 to 55 wt.% of Ni and 35 to 85 wt.% of Fe and wherein 30 to 70% of the first metallic component in the part of the depth of 0.01 to 50μ from the surface is removed by said etching.

13. An electrode according to claim 12 wehrein the electrode is a cathode used in an electrolysis of an aqueous solution of an alkali metal chloride.

14. An electrode according to clain 12 wherein the etching is carried out immersing the alloy substrate in an aqueous solution of an alkali metal hydroxide at 90° to 250° C. for 1 to 100 hours.

15. An electrode according to claim 12 wherein the aqueous solution of an alkali metal hydroxide is an aqueous solution of sodium hydroxide.

16. An electrode according to claim 12 wherein the etching is an anodic polarization of the alloy substrate in an electrolytic cell under a potential of the plate to the saturated calomel electrode of −3.5 to +12.0 Volt for 1 to 500 hours.

17. An electrode according to claim 12 wherein the etching is to treat the alloy substrate in an electrolytic cell by applying a potential for an anodic polarization under a current density of 100 μA to 10,000 $A/dm^2$ for 1 to 500 hours.

18. An electrode according to claim 12 wherein the alloy substrate is treated by a sand blasting before the etching.

19. An electrode according to claim 12 wherein said etching is sufficient to form $10^3$ to $10^8$ per $cm^2$ pores of average depths of 0.01 to 50μ on the surface of the substrate.

20. An electrode according to claim 12 wherein an electric double layer capacity of the surface layer is greater than 5000 $\mu F/cm^2$.

21. An electrode prepared by etching at least a portion of a first metallic component from an alloy substrate which alloy comprises a first metallic component selected from the group consisting of chromium, manganese, tantalum, niobium, vanadium, titanium, zirconium, germanium, scandium, yttrium and lanthanum and a second metallic component selected from the group consisting of iron, nickel, tungsten, silver, cobalt and molybdenum, wherein 1 to 70 wt.% of the first metallic component is removed from the alloy comprising 1 to 30 wt.% of the first metallic component and 70 to 99 wt.% of the second metallic ocmponent.

22. An electrode prepared by etching at least a portion of a first metallic component from an alloy substrate which alloy comprises a first metallic component selected from the group consisting of chromium, manganese, tantalum, niobium, vanadium, titanium, silicon, zirconium, germanium, scandium, yttrium, lanthanum and alloys thereof and a second metallic component selected from the group consisting of iron, nickel, tungsten, copper, silver, cobalt, molybdenum and alloys thereof wherein the surface layer of the electrode comprises 15 to 90 wt.% of Fe, 10 to 75 wt.% of Ni and 0 to 20 wt.% of Cr.

23. An electrode prepared by etching at least a portion of a first metallic component from an alloy substrate which alloy comprises chromium as the first metallic component and nickel as a second metallic component wherein the alloy comprises components of 5 to 50 wt.% Cr and 40 to 80 wt.% Ni and wherein 30 to 70% of the first metallic component in the part of the depth of 0.01 to 50μ from the surface is removed by said etching.

24. An electrode according to claim 23 wherein the electrode is a cathode used in an electrolysis of an aqueous solution of an alkali metal chloride.

25. An electrode according to claim 23 wherein the etching is carried out immersing the alloy substrate in an aqueous solution of an alkali metal hydroxide at 90° to 250° C. for 1 to 500 hours.

26. An electrode according to claim 23 wherein the aqueous solution of an alkali metal hydroxide is an aqueous solution of sodium hydroxide.

27. An electrode according to claim 23 wherein the etching is an anodic polarization of the alloy substrate in an electrolytic cell under a potential of the plate to the saturated calomel electrode of −3.5 to +2.0 Volt for 1 to 500 hours.

28. An electrode according to claim 23 wherein the etching is to treat the alloy substrate in an electrolytic cell by applying a potential for an anodic polarization under a current density of 100 μA to 10,000 $A/dm^2$ for 1 to 500 hours.

29. An electrode according to claim 23 wherein the alloy substrate is treated by a sand blasting before the etching.

30. An electrode according to claim 23 wherein an electric double layer capacity of the surface layer is greater than 5000 $\mu F/cm^2$.

31. An electrode prepared by etching at least a portion of a first metallic component from an alloy substrate which alloy comprises chromium as the first metallic component and nickel as a second metallic component wherein the alloy comprises components of 5 to 50 wt.% chromium and 40 to 80 wt.% nickel and wherein said etching is sufficient to form $10^3$ to $10^8$ per $cm^2$ pores of average depth of 0.01 to 50 micron on the surface of the substrate.

* * * * *